United States Patent [19]

Landis

[11] 4,111,774

[45] Sep. 5, 1978

[54] ELECTROFILTRATION OF ANIMAL FATS

[75] Inventor: Joel Victor Landis, Houston, Tex.

[73] Assignee: Petrolite Corporation, St. Louis, Mo.

[21] Appl. No.: 768,002

[22] Filed: Feb. 11, 1977

[51] Int. Cl.[2] ..... B03C 5/00

[52] U.S. Cl. ..... 204/186; 204/131

[58] Field of Search ..... 204/186, 302, 167, 149, 204/152, 131, 180 R

[56] References Cited

U.S. PATENT DOCUMENTS

| | | | |
|---|---|---|---|
| 1,162,213 | 11/1915 | Bloom | 204/186 |
| 1,326,968 | 1/1920 | Rogers | 204/131 |
| 3,394,067 | 7/1968 | Shirley | 204/186 |
| 3,928,158 | 12/1975 | Fritsche | 204/302 |

*Primary Examiner*—T. M. Tufariello

*Attorney, Agent, or Firm*—Sidney B. Ring; Hyman F. Glass

[57] ABSTRACT

This invention relates to the electrofiltration of rendered animal fat. By means of this process, foreign bodies present in said fat are facilely removed without the conventional steps of water washing, centrifugation and drying. The use of electrofiltration instead of water washing, centrifugation and drying, besides avoiding the operation steps, also minimizes hydrolysis of fats to fatty acids. In addition, the physical loss of fat, which usually occurs during washing and subsequent steps, is minimized; and impurities not conventionally removed by water washing are removed, such as trace metals, etc. The electrofiltered product is a refined lard or tallow which is superior to lard or tallow prepared by conventional procedures.

8 Claims, 1 Drawing Figure

ELECTROFILTRATION OF ANIMAL FATS

Figure 1:
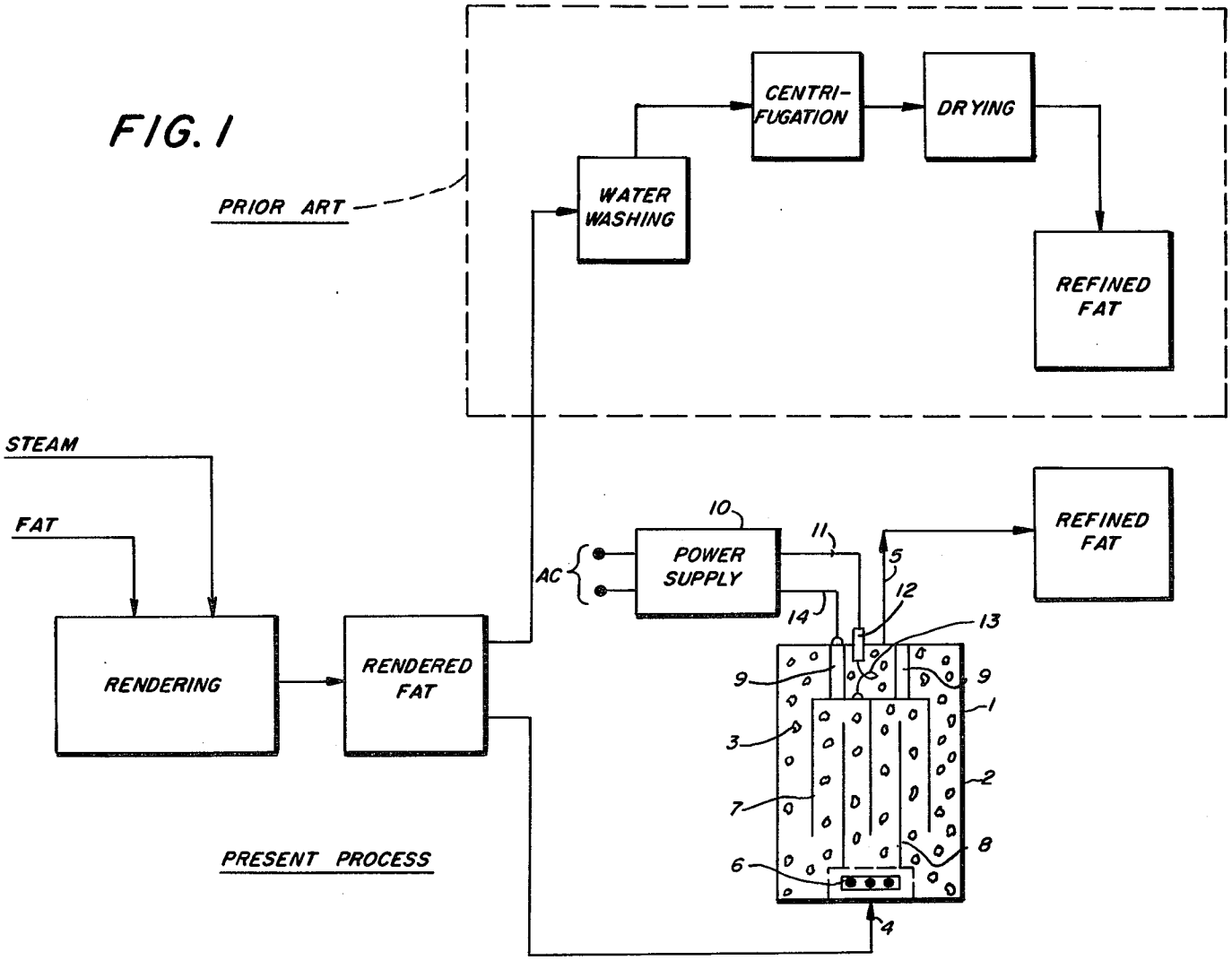

Animal fats, such as that derived from cattle and hogs, etc., are rendered from fatty stocks by a variety of methods. Typical examples are the so-called Dry and Wet Rendering Process.

Dry Rendering is distinguished from Wet Rendering in that the dehydration of fat is accompanied by dehydration of fat and fatty tissues so that the latter is essentially dry at the end of the operation.

Dry Rendering is preferred for inedible products where flavor and odor are secondary and the production of large quantities of high quality residues is important.

Wet Rendering is generally used for edible products where color, flavor and keeping quality are of prime importance and the relative residue is small. There are two varieties of Wet Rendering — low temperature rendering up to the boiling point of water and high temperature steam rendering under pressure in closed vessels.

Most of the animal fat produced in the United States is rendered by the steam process. Thus in most instances lard, tallow or fish oil such as whale oil are usually steam rendered.

Tallow or lard, thus rendered, contains foreign bodies such as proteins, etc., and must be treated to yield refined lard or tallow. Refining is carried out by treatment with a hot water washing (with or without "Fuller's" earth) followed by centrifugation and drying. In the course of refining, the acid number of the fat is increased and certain amounts of fats are physically lost. in addition, certain materials present in the fats are not removed by water washing, such as metals, etc. This process is designated "Prior Art" in the Drawing.

I have now discovered a process of refining rendered edible animal fat which is characterized by the electrofiltration of such edible animal fat in liquid form. By means of this process, foreign bodies present in the fat are facilely removed without the necessity of water washing, followed by centrifugation and drying of the water washed fat. The use of electrofiltration instead of water washing, centrifugation and drying, besides avoiding the operational steps, also minimizes the hydrolysis of fats to fatty acids. In addition, the physical loss of fat which usually occurs during washing and subsequent steps is minimized, and impurities not conventionally removed by water washing are removed, such as trace metals, etc. The electrofiltered product is a refined lard or tallow superior to lard or tallow prepared by conventional procedures. The Electrofiltration Process is designated as "Present Process" in the Drawing.

The electrofilter will tolerate or remove a certain amount of water from the animal fats. When the amount of water in the animal fats poses an excess load on the electrofilter, the rendered animal fat is dried prior to electrofiltration.

In accordance with this invention, there is provided a process for refining animal fats. The rendered animal fat in liquid form is subjected to electrofiltration by passage through a bed of dielectric particulate solids interposed within a d.c. electric field having a gradient of at least 20 kilovolts per inch whereby the finely divided solid material in substantial totality adheres to the particulate solids in the bed and provides refined animal fats that are substantially free of finely divided solid material. The refined animal fat is passed to a subsequent utilization. The electric field in the bed of particulate solids is periodically interrupted and then, a dielectric fluid is circulated therethrough to remove the priorly adhering finely divided solid material.

The difference between the "prior art" and the "present process" is graphically presented in the drawing.

The electrofilter 1 is a metal pressure vessel 2 containing a porous bed of dielectric particulate solids 3 disposed in an intense d.c. electric field so that the solid materials in the fat are substantially removed by their induced adherence to the particulate solids. The electrofilter 1 can be of commercial design sold in the marketplace under the designation Petreco ® Electro-Filter™ Separator. The electrofilter 1 has an inlet 4 and an outlet 5. The fat flows from the inlet 4 into a distributor 6 provided by pipe crossarms containing metering openings. The interior of the vessel contains a plurality of energized electrodes 7 in spaced relationship to a plurality of internested grounded electrodes 8. Preferably, the electrodes 7 and 8 are vertically elongated metal tubes that have substantial overlapping dimensions defining an electric field within the particulate solids 3. The electrodes 7 are suspended from the vessel by insulators 9. In addition, the electrodes 7 are energized by an external power supply 10 having a connection to an a.c. power source and providing a high intensity potential through a conductor 11, an entrance bushing 12 and a flexible lead 13 to the electrodes 7. The power supply 10 can be grounded to the vessel 2 by the conductor 14 so that the vessel 2 provides an additional grounded electrode.

The d.c. electric field induces the tenacious adhesion of the finely divided solid material upon the particulate solids 3. The power supply 10 should provide a sufficient intensity d.c. electric field within the particulate solids 3 contained within the electric field defined by the electrodes 7 and 8. Preferably, the electric field produces a potential gradient in the particulate solids 3 of not less than about 20 kilovolts per inch. A certain type of particulate solids should be employed for optimum results. Preferably, the solids 3 are composed of a rigid solid material having a relatively low dielectric constant (e.g., below about 6 at 1 kilohertz). More particularly, the particulate solid is chemically inert, incompressible, hard, granular and rigid in nature. The particulate solids can be a solid mineral material containing crystalline silicon dioxide, such as flint, garnet, granite and fused quartz. Preferably, the mineral is crushed to provide nonspheroidal configurations which have relatively discontinuous surfaces. As shown in Example 1, crushed flint rock having particulate sizes with minimum dimensions between about one-eighth and one-half inch is employed to good advantage as in the present process. Glass, including glass beads, can also be employed as the particulate solid.

The electrofilter 1 produces, for practical purposes, the substantially complete removal of the finely divided solid materials. In addition, the electrofilter 1 also removes small amounts of entrained water. It appears also that phosphatides, carbohydrates, and other nonglyceride extractives in some instances are removed concurrently with the finely solid materials. The resultant improvement in color and subsequently low refining losses indicates that the electrofilter 1 does produce this removal of additional materials besides the finely divided solid materials.

Eventually the electrofilter 1 removes such large amounts of the finely divided solid material from the animal fat that the electric field is no longer adequate to produce refined animal fat. At this time, or some selected time period or by throughput volume, the electrofilter 1 is cleaned and restored to original operating efficiency. For this purpose, the power supply 10 is deactivated to terminate the d.c. electric field within the electrofilter 1. Then, a dielectric fluid is circulated through the particulate solids 3 to remove the adhering finely divided solid material. Stated in another manner, without the electric field being present, the circulating dielectric fluid removes all of the adhering finely divided solid materials from the particulate solids 3 within the electrofilter 1. Preferably, this dielectric fluid is the animal fat itself or another suitable dielectric solvent, i.e., a solvent having a low dielectric constant, e.g., below 8 at 1 kilohertz and having a specific resistivity not less than about 50,000 ohm-centimeters. The cleaning solvent may be recovered from the solids washed out by any suitable means such as distillation, filtration, centrifugation, electrofiltration, etc., or combinations thereof.

The following example is presented by way of illustration and not of limitation.

EXAMPLE 1

Rendered animal fat having an average water content of 0.16% by weight was heated to 200° F and in a liquid form passed through an electrofilter containing flint rock at about one-eighth to one-half inch particle size at an initial voltage of 25 kilovolts and an amperage of 0.55 milliamps and a final voltage of 25 kilovolts and an amperage of 0.25 milliamps.

The electrofiltered product obtained (III) was compared with the unrefined rendered fat (I) and rendered fat refined by a water wash (II) with the following results.

Table A

| | Lovibond Color | Free Fatty Acid (FFA) | Hi-Heat Color* |
|---|---|---|---|
| I Unrefined | 2.5 | 0.15 | 3.8 |
| II Refined by water wash | 1.4 | 0.20 | 1.9 |
| III Electrofiltered | 1.6 | 0.15 | 1.9 |

*Hi-Heat Color is a test which indirectly measures the residual proteination particulates which will darken the oil with the addition of concentrated HCl and elevation of the temperature to 450° F under vacuum.

From the above Table, it is evident that Lovibond Color and Hi-Heat Color of the water washed fat and the electrofiltered animal fats are essentially the same. The FFA of the electrofiltered fat is essentially the same as the unrefined fat and 25% less than the water washed fat. Conventionally refined water washing has increased FFA; electrofiltered fat has unchanged FFA.

In addition, electrofiltration avoids the steps of water washing and vacuum drying which are tedious, expensive, requiring the handling and treating of waste water. Furthermore, refining by washing involves an average fat loss during washing of about 0.8% by weight, which not only adds to the cost of the fat but also poses a pollution problem.

It will be apparent that there has been provided a process for refining animal fats without the disadvantages of conventional processes. The present process is completely compatible with conventional operations in the food industry or other places where fats are refined. Of special advantage is the intimate combination and cooperation in the use of an electrofilter in purification of animal fats to remove finely dispersed solid materials and also in the periodic cleaning of the electrofilter of traped finely divided solid material. It is to be understood that certain features and operations of the present process may be employed without departing from the spirit of this invention. Such variations are contemplated by, and are within, the scope of the appended claims. It is intended that the foregoing description is to be taken as an illustration of the present invention.

What is claimed is:

1. The process of treating rendered animal fat to remove finely divided solids and nonglyceride extractives with essentially no hydrolysis of the fat, comprising passing said rendered animal fat in liquid form through a bed of dielectric particulate solids interposed within a d.c. electric field, whereby a refined fat having an improved color and essentially the same fatty acid content as the starting fat is obtained.

2. The process of claim 2 wherein the electric field in the bed of particulate solids is periodically interrupted and a dielectric fluid is circulated therethrough to remove the solid materials adhering to said particulate solids.

3. The process of claim 1 wherein said d.c. electric field has a gradient of at least about 20 kilovolts per inch.

4. The process of claim 3 wherein said dielectric particulate solids have a dielectric constant below about 6 at 1 kiloherz and are inert, incompressible, hard, granular and rigid in nature.

5. The process of claim 4 wherein said dielectric particulate solids are of mineral material containing crystalline silicon dioxide.

6. The process of claim 4 wherein said dielectric particulate solids are selected from the group consisting of flint, garnet, granite, fused quartz and glass.

7. The process of claim 2 wherein said dielectric fluid is a solvent having a dielectric constant below 8 at 1 kiloherz and a specific resistivity not less than about 50,000 ohm-centimeters.

8. The process of claim 2 wherein said dielectric fluid is rendered animal fat identical to that being refined.

* * * * *